US007042349B2

(12) United States Patent
Bergman et al.

(10) Patent No.: US 7,042,349 B2
(45) Date of Patent: May 9, 2006

(54) TESTING AND INSTALLING SENSORS IN A SECURITY SYSTEM

(75) Inventors: John Bergman, River Falls, WI (US); Gary Friar, Tigard, OR (US); David Mayne, Eagan, MN (US)

(73) Assignee: General Electric Company, Schenectady, NY (US)

( * ) Notice: Subject to any disclaimer, the term of this patent is extended or adjusted under 35 U.S.C. 154(b) by 54 days.

(21) Appl. No.: 10/232,882

(22) Filed: Aug. 30, 2002

(65) Prior Publication Data

US 2004/0041703 A1 Mar. 4, 2004

(51) Int. Cl.
*G08B 29/00* (2006.01)

(52) U.S. Cl. ..... 340/514; 340/539.1; 340/628

(58) Field of Classification Search ..... 340/514, 340/500, 506, 515, 539.1, 525, 72, 628, 825.72; 73/609

See application file for complete search history.

(56) References Cited

U.S. PATENT DOCUMENTS

| | | | | |
|---|---|---|---|---|
| 4,908,602 | A * | 3/1990 | Reich et al. | 340/514 |
| 5,140,306 | A * | 8/1992 | Hemphill, Sr. | 340/524 |
| 5,686,885 | A * | 11/1997 | Bergman | 340/514 |
| 5,686,896 | A * | 11/1997 | Bergman | 340/636.1 |
| 6,175,307 | B1 | 1/2001 | Peterson | 340/531 |
| 6,624,750 | B1 * | 9/2003 | Marman et al. | 340/506 |

* cited by examiner

*Primary Examiner*—Phung T. Nguyen
(74) *Attorney, Agent, or Firm*—Armstrong Teasdale LLP

(57) ABSTRACT

A security system includes a sensor and a control panel that receives transmissions from the sensor. The sensor has a user-operable testing actuator that tests a condition sensing device in the sensor. A method of operating the sensor includes generating, in response to actuation of the testing actuator in the absence of a predetermined condition, a transmission from the sensor including information indicating that a test of the sensor has been conducted. The method further includes receiving by the control panel, in response to actuation of the testing actuator in the presence of the predetermined condition, a transmission from the sensor indicating that the control panel should not report to a monitoring station.

40 Claims, 8 Drawing Sheets

TESTING AND INSTALLING SENSORS IN A SECURITY SYSTEM

BACKGROUND OF THE INVENTION

The invention relates to security systems having sensors that communicate with a central control panel, and in particular to the testing and installing of sensors in such a system.

Sensors, for example smoke detectors, may include a test button that is pressed to determine whether the smoke detector is working properly (for example, that its battery is still sufficiently charged). In many systems, pressing the test button causes an alarm signal to be transmitted, which in turn is received by a control panel of the system. One problem with this test button is that the control panel in such a system is not able to distinguish between an alarm signal caused by the sensing of smoke and an alarm signal caused by the pressing of the test button.

To overcome this limitation, some control panels include a "test mode," and when put in this "test mode," received alarm signals are considered by the control panel to have been generated by a test of a sensor and not by sensing an alarm condition. But if the control panel is not first put in the test mode, the control panel falsely considers a received alarm signal generated by a test of a sensor to be an actual alarm condition. The control panel then dials up and contacts a remote monitoring station and notifies the monitoring station of an alarm condition, which in turn leads to the dispatch of the police or fire department.

In addition, fraud prevention controls commonly instituted in connection with the installation of a security system may require installers to provide proof that they have actually installed all sensors the homeowner has purchased. To provide that proof, the installers typically test each sensor by generating an alarm signal that the control panel will in turn transmit to the monitoring station. Before the installer does such a test, the installer telephones the monitoring station and notifies the station that a test is going to be conducted and the alarm signals that soon will be received are not actual alarms.

Currently, security systems do not contact a remote monitoring station except to report alarm conditions, conduct phone line tests, and to report armings and disarmings. As such, the control panel, in response to the receipt of an alarm signal and accompanying test indicator, will not contact the monitoring station, and pressing a test button will not provide an audit message that the monitoring station needs to have to know that a sensor has been installed. To overcome this limitation, in the case of smoke detectors as an example, an installer may carry a can of artificial smoke which is sprayed into the smoke detector to generate the transmission of an alarm signal without the test signal. The control panel considers such a transmission to be an actual alarm and notifies the remote monitoring station accordingly. The cost and inconvenience of such an approach makes it undesirable.

BRIEF DESCRIPTION OF THE INVENTION

In one aspect, a method is provided for operating a sensor in a security system having a control panel that receives transmissions from the sensor and the sensor has a user-operable testing actuator that tests a condition sensing device in the sensor. The method comprises generating, in response to actuation of the testing actuator in the absence of a predetermined condition, a transmission from the sensor including information indicating that a test of the sensor has been conducted. The method further comprises receiving by the control panel, in response to actuation of the testing actuator in the presence of the predetermined condition, a transmission from the sensor indicating that the control panel should not report to a monitoring station.

In another aspect, a method is provided for operating a sensor in a security system having a central control panel that receives transmissions from the sensor. The sensor has first and second user-operable testing actuators. At least one of the first and second actuators test a condition sensing device in the sensor. The method comprises generating, in response to actuation of the first actuator, a transmission from the sensor including information indicating that a test of the sensor has been conducted. The method further comprises receiving by the control panel, in response to actuation of the testing actuator in the presence of the predetermined condition, a transmission from the sensor indicating that the control panel should not report to a monitoring station.

In another aspect, a sensor is provided for use in a security system having a control panel that receives transmissions from the sensor. The sensor comprises a sensing device for sensing a condition and having an output indicating whether or not the sensed condition is present, a testing actuator that when actuated conducts a test of the sensing device and causes the sensing device output to indicate that the sensed condition is present if the sensor is working properly, and at least one control and communications application that receives the output of the sensing device and senses whether the testing actuator has been actuated. The control and communications application transmits, in response to the sensing device output indicating that the sensed condition is present and that the testing actuator was actuated in the absence of a predetermined condition, a signal for receipt by the control panel including information that the testing actuator was actuated, and transmits, in response to the sensing device output indicating that the sensed condition is present and that the testing actuator was actuated in the presence of a predetermined condition, a signal for receipt by the control panel including information that the sensing device output is indicating that the sensed condition is present but not that the testing actuator was actuated.

In another aspect, a sensor is provided for use in a security system having a control panel that receives transmissions from the sensor. The sensor comprises a sensing device for sensing a condition and having an output indicating whether or not the sensed condition is present, first and second actuators, when at least one of the first and second actuators is actuated, it conducts a test of the sensing device and causes the sensing device output to indicate that the sensed condition is present if the sensor is working properly, and at least one control and communications application that receives the output of the sensing device and senses whether the actuators have been actuated. The control and communications application transmits, in response to the sensing device output indicating that the sensed condition is present and that the first actuator was actuated, a signal for receipt by the control panel including information that a test of the sensing device has been conducted, and receives from the sensing device a signal for receipt by the control panel including information indicating that the control panel should not report to a monitoring station.

In another aspect, a method is provided for use in a security system for a premises. The security system comprises a plurality of sensors that transmit to a control panel which in turn communicates with a remote monitoring station. The method comprises receiving at the control panel a first type of transmission from one of the plurality of sensors, the first type of transmission including information that a test of the sensing device was conducted, if the control panel is operating in a first mode, upon receiving a transmission of the first type, the control panel does not send a communication to the remote monitoring station indicating the presence of an alarm condition at the premises, and if the control panel is operating in a second mode, upon receiving a transmission of the first type, the control panel sends a communication to the remote monitoring station indicating the presence of an alarm condition at the premises and information identifying the sensor that sensed the alarm condition.

In another aspect, a method is provided for use in a security system for a premises. The security system comprises at least one sensor that transmits to a control panel which in turn communicates with a remote monitoring station. The method comprises receiving, at the control panel and from a sensor, a transmission including sensor identifying information, and forwarding in a verification mode, from the control panel to the remote monitoring station, the sensor identifying information for the sensor.

In another aspect, a control panel is provided for a security system for a premises having at least one sensor that communicates with the control panel which communicates with a remote monitoring station. The control panel comprises a receiver to receive transmissions from at least one sensor, a communications application to communicate with the remote monitoring station, a user settable mode selector to place the control panel in a verification mode, a controller, and memory having instructions stored thereon. When the instructions are executed by the controller, the controller performs the following operations: upon receiving sensor information, the controller stores in memory sensor identifying information for the sensor, and if in a verification mode, communicating the sensor identifying information to the remote monitoring station.

DETAILED DESCRIPTION OF THE INVENTION

Figure 1:
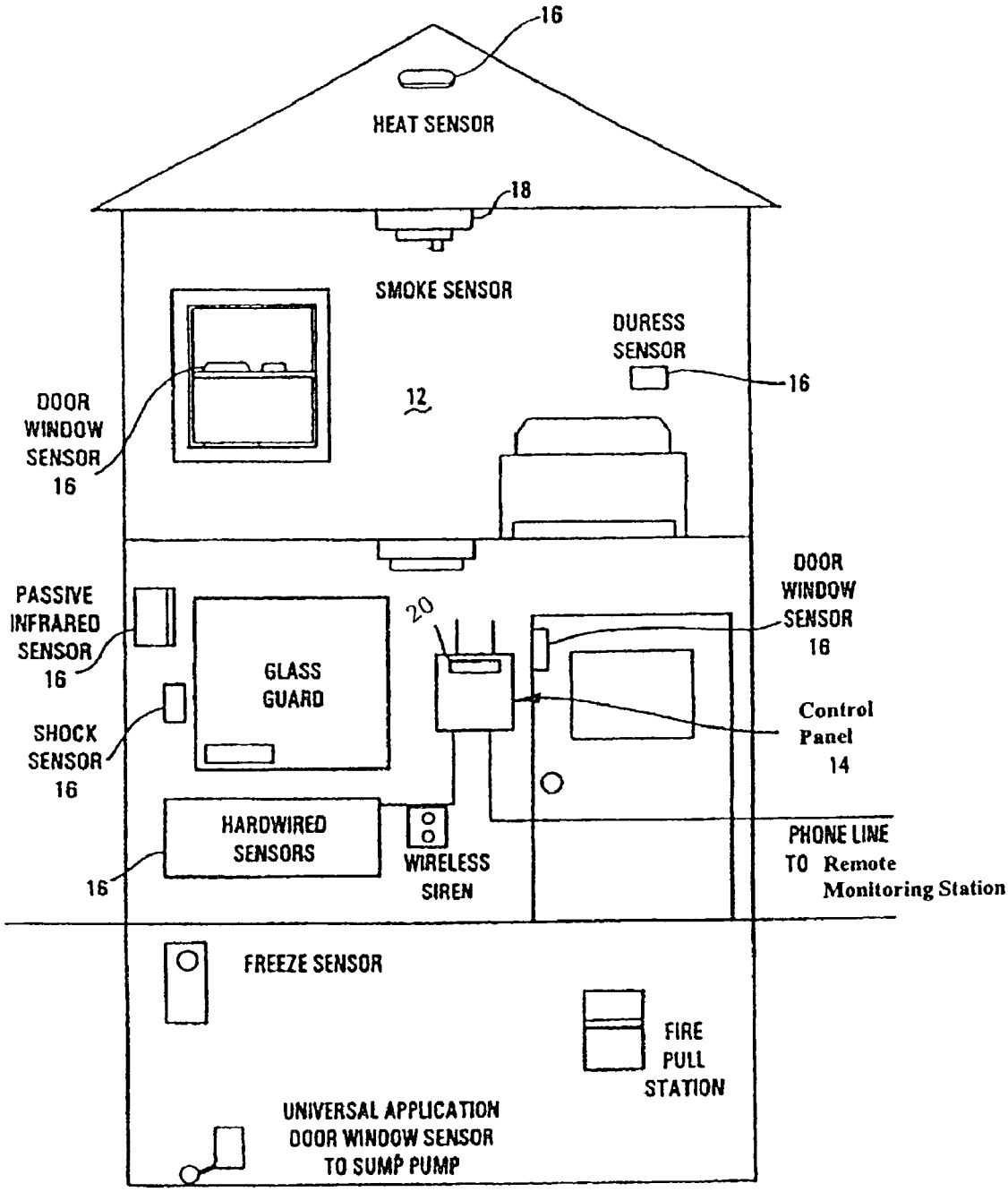
FIG. 1 is system diagram of a security system with wireless and hard-wired sensors that may include aspects of the invention.

The below described system and method allow a user, such as a homeowner, to test various types of sensors in a security system easily and efficiently without sending unwanted false alarm communications to a remote monitoring station. In addition, a user, such as a security system installer, is allowed to send to the remote monitoring station communications easily and efficiently about a sensor, for example, during the installation of the security system as a fraud prevention measure.

In one embodiment, the security system with which the sensor is used has a central control panel that receives transmissions from the sensor. The control panel may in turn communicate with a remote monitoring station. The sensor has a sensing device that senses a sense condition (for example, smoke or heat associated with a fire) and provides an output indicating whether or not the sense condition is present. The sensor also has a user-operable testing actuator that tests the sensing device and causes it to generate an output indicating the presence of the sense condition if the sensor is working properly. In response to the testing actuator being actuated in the absence of a predetermined condition, the sensor generates a transmission including information indicating the presence of the sense condition and information indicating that a test of the sensor was conducted. Alternatively, in response to the testing actuator being actuated when the predetermined condition is present, the sensor generates a transmission including information indicating the presence of the sense condition but not information indicating that a test of the sensor was conducted. By actuating the testing actuator in the presence of the predetermined condition, the sensor generates what appears to be, from the perspective of a control panel that will receive the transmission, an indication that an alarm condition is present.

The user-operable testing actuator may be, for example, a button provided on an external housing of the sensor, as is typical with most smoke detectors. The predetermined condition, in different implementations, may be a tamper condition being present (for example, when the housing of the sensor is open, or when the unit is not attached to its mounting base or ring), the presence of batteries having been recently installed in the sensor, the continued actuation of the testing actuator for a predetermined period of time, or a combination of these conditions. In one embodiment, the actuator is a dedicated switch for use by an installer. In the example where the predetermined condition is the continued actuation of the testing actuator for a predetermined period of time, the control panel, or the sensor itself, may provide, after the testing actuator has been actuated for a period of time less than the predetermined period of time, an audible or visual indication. The indication is intended to inform a user that the sensor will imminently make, if the testing actuator continues to be actuated, the type of transmission made when the predetermined condition is present. In addition, the control panel provides the user an abort window in which the imminent report can be canceled. If the alarm transmission is not immediately preceded by the test, then the control panel does not provide this abort window. This type of transmission includes information indicating the presence of the sense condition but not information indicating that a test was conducted.

Upon receiving a transmission from a sensor including information indicating the presence of the sense condition and information indicating that a test was conducted, e.g., the testing actuator is actuated when the predetermined condition is absent, the control panel does not communicate with the remote monitoring station. As such, a homeowner's test of the sensor by pressing a test button, for example, does not cause a false alarm to be reported to the remote monitoring station. Alternatively, upon receiving a transmission from a sensor including information indicating the presence of the sense condition but without information indicating that a test of the sensor was conducted (whether the transmission was caused by the presence of the sense condition or by the testing actuator being actuated with the predetermined condition present), the control panel communicates to the remote monitoring station information that the sense condition was sensed. The control panel may also provide information identifying the sensor that sensed the sense condition. As such, the predetermined condition is used by an installer, for example, to easily and efficiently cause a communication from the control panel to the remote monitoring station for purposes of fraud prevention measures.

In another implementation, instead of, or in addition to, using the predetermined condition as described previously, the sensor may be provided with an additional, second testing actuator. As with the previously discussed embodiment, in response to the first testing actuator being actuated, the sensor generates a transmission including information indicating the presence of the sense condition and information indicating that a test of the sensor was conducted. In response to actuation of the second testing actuator, however, the sensor generates a transmission including information indicating the presence of the sense condition but not information indicating that a test of the sensor has been conducted.

In this dual testing actuator implementation, the first testing actuator may be a test button provided on an external housing of the sensor and easily accessible by a homeowner, as is typical with smoke detectors, for example. The second testing actuator, however, is preferably not easily accessible to reduce the possibility of accidental actuation by the homeowner and/or the installer. In one implementation, the second testing actuator is inside the sensor's housing, and the housing has a small hole through which a triggering tool, e.g., an extended paper clip, may be extended to actuate the testing actuator within.

The control panel, upon receiving a transmission from a sensor including information indicating the presence of the sense condition and information indicating that a test was conducted, e.g., when the first of the two testing actuators has been actuated, the control panel does not communicate with the remote monitoring station. Upon receiving a transmission from a sensor including information indicating the presence of the sense condition but without information indicating that a test of the sensor was conducted (whether the transmission was caused by the presence of the sense condition or by the second testing actuator being actuated), the control panel communicates to the remote monitoring station information that the sense condition was sensed, and also may provide information identifying the sensor that sensed the sense condition.

In another embodiment, a control panel is provided for a security system for a premises, as well as a method of operating such a control panel. The control panel uses a special mode of operation to prompt a communication to a remote monitoring station when that otherwise would not occur. If the control panel is operating in a first mode (for example, a normal operating mode where the security system is "disarmed"), upon the control panel receiving a sensor transmission including information indicating both the presence of the sense condition and that a test was conducted, the control panel does not send a communication to the remote monitoring station. If, however, the control panel is operating in a second mode (for example, an installation mode), upon receiving the same such transmission, the control panel sends a communication to the remote monitoring station indicating the presence of the sense condition at the premises, and perhaps information identifying the sensor that provided the transmission to the control panel.

This installation mode of operation for the control panel may be used to provide a communication to the remote monitoring station when such a communication is needed, again for example during installation as a fraud prevention measure. In addition, this capability is provided without the need for sensors that utilize the predetermined condition or an additional testing actuator to provide a transmission that appears to be an alarm transmission when it actually is not.

In a further embodiment, the control panel has a special mode of operation to prompt a communication to a remote monitoring station when that otherwise would not occur. In the first mode as with the previously discussed embodiment, upon receiving a transmission from a sensor including information of the presence of the sense condition and that a test of the sensor was actuated, the control panel does not send a communication to the remote monitoring station. If, however, the control panel is operating in a second mode (for example, a verification mode as part of the installation process), upon receiving the same such transmission, the control panel communicates sensor identifying information to the remote monitoring station for the sensors that provided transmissions to the control panel. Again, this may be done, for example, to verify that the sensors have been installed at the premises.

In either of the embodiments of a control panel with a special mode to provide a communication to the remote monitoring station when that otherwise would not occur, the control panel may receive a transmission from a sensor indicating the presence of a sense condition but that a test of the sensor has not been conducted. Such would be the case, for example, when the sense condition is actually present and an alarm needs to be reported. If this happens, and if the operating mode for the control panel is one where alarm conditions are normally reported to the remote monitoring station (for example, in a normal operating mode), a communication to the remote monitoring station will be made indicating the presence of the sense condition at the premises, and possibly providing information identifying the sensor.

The sensor described above may be any variety of sensors, such as a smoke detector, door/window sensor, etc. Also, the method and systems applies to wireless security systems where sensors communicate with the control panel by radio frequency (RF) transmissions, and also to hard-wired security systems where sensors are hard-wired to the control panel and where the transmissions from sensor to control panel are provided over that hard-wired connection.

FIG. 1 is a system diagram of a security system 12 that can be used to monitor various security conditions in a premises such as a home or business. Security system 12 includes a control panel 14 and a variety of sensors 16 including a smoke detector 18. In one embodiment, sensors 16 can use a wired communication path to transmit to control panel 14 the security condition information including alarm and test signals. In a similar manner, smoke detector 18 transmits security condition information to control panel 14 over a wireless communications path. Control panel 14 monitors sensors 16 and smoke detector 18 for receipt of the security condition information and determines whether to report such information to an off-premises, remote monitoring station (not shown). Control panel 14 contains a visual display 20 that displays the security conditions to a user.

Figure 2:
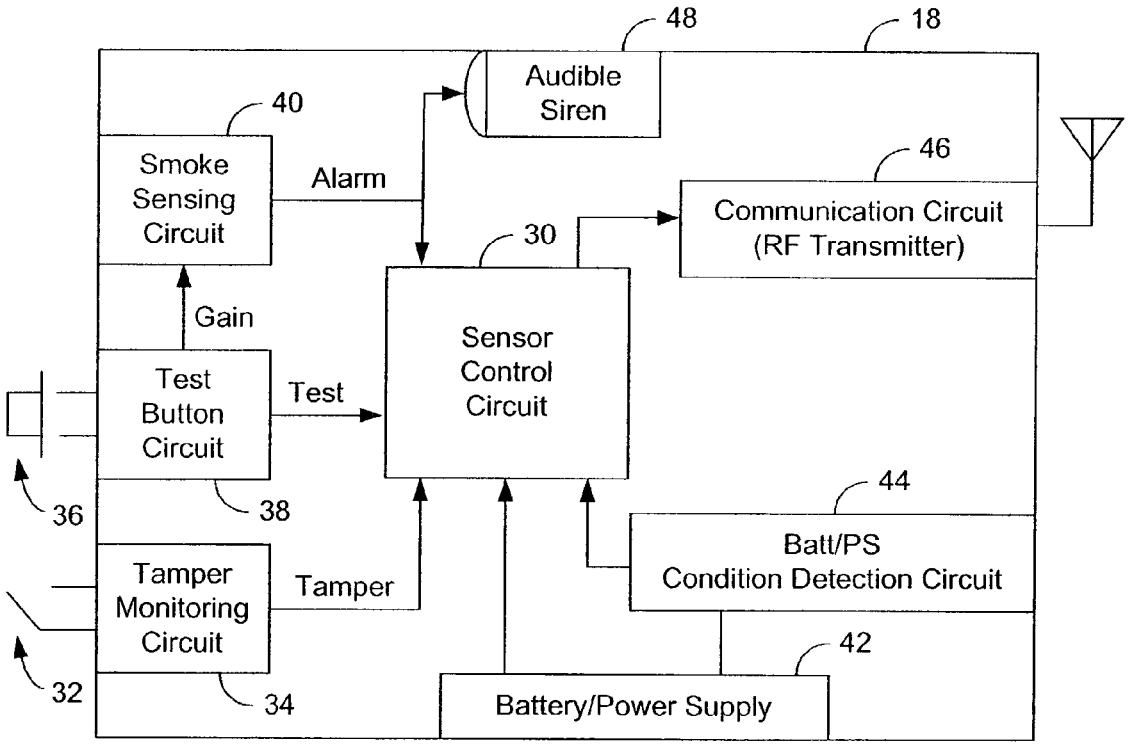
FIG. 2 is a block diagram of a wireless sensor in accordance with an embodiment of the invention.

FIG. 2 is a functional block diagram of a smoke detector such as smoke detector 18 shown in FIG. 1, according to one embodiment of the invention. Smoke detector 18 includes a sensor control application 30 (e.g., a circuit or a software routine) that manages a tamper switch 31 associated with a tamper monitoring application 34 (e.g., a circuit or a software routine), a test button 36 associated with a test button application 38 (e.g., a circuit or a software routine), a smoke sensing application 40 (e.g., a circuit or a software routine), a power supply 42, a power supply condition detection application 44 (e.g., a circuit or a software routine), a communication application 46 (e.g., a circuit or a software routine), and an audible siren 48. Tamper monitoring application 34 detects the presence of tampering and provides a tamper signal indicating such presence to sensor control application 30. For example, tamper monitoring application 34 in conjunction with tamper switch 32 detects whether tampering has occurred with smoke detector 18. Tamper switch 32, as is conventional, may be in a closed state when the encasement of detector 18 is closed, but then opens when the encasement is opened. Alternatively, tamper switch 32 is closed when detector 18 is in its installed mounted state, and open when detector 18 is removed from such a state.

Test button application 38 detects the activation of the test button 36 and provides a test signal to sensor control application 30 and also provides a gain signal to smoke sensing application 40 for reasons that are described later. Sensor control application 30 can use the test signal to determine whether test button 36 is in an open or depressed state, and may also measure the length of time that button 36 has been depressed.

In one embodiment, smoke sensing application 40 is a circuit including circuitry to detect the presence of smoke and/or a heat condition associated with a fire and to generate an alarm signal indicating the presence of such a condition to sensor control application 30. As is conventional, the presence of smoke obscuration or heat alters the level of an electrical signal in smoke sensing application 40 that is compared to a threshold level to determine if the sensed condition is present. When the electrical comparison is met or exceeded, smoke sensing application 40 produces an alarm signal (ALARM). When test button 36 is pressed, the gain signal (GAIN) thus provided to the smoke sensing application 40 changes the electrical comparison condition, and causes smoke sensing application 40 to produce the alarm condition (ALARM) output even when the sensed condition is not present, if the sensor is working properly—that is, smoke sensing application 40 is in working order and the charge on power supply 42 is sufficient.

Power supply 42, such as an internal battery as shown in FIG. 2, or an external alternating current (AC) power source, provides power to the smoke detector 18. Power supply condition detection application 44, monitors the condition of power supply 42 and provides a signal to sensor control application 30. The signal may be, for example, an indication of the level of charge on the battery, from which sensor control application 30 may determine, for example, the present power capacity of the battery, whether a new battery has been recently installed, and whether it is time to replace the battery. Audible siren 38 may sound locally when an ALARM condition exists, and may "chirp," for example, when a low-battery condition is present. Although not shown, the sensor may also include a light indicator to provide the user with a visual indication of the status of the sensor.

In one embodiment, sensor control application 30 is a circuit and includes internal circuitry (not shown) that processes signals it receives (for example, ALARM, TEST, and TAMPER) and generates appropriate responses. A communication application 46 is connected to sensor control application 30 and sends transmissions that are to be received by control panel 14 (shown in FIG. 1). An exemplary communication application 46 is a radio frequency (RF) transmitter capable of communicating wirelessly As discussed below, sensor control application 30 can be configured to process various types of smoke detector tests. The details of implementing sensor control application 30 and communication application 46 are within the scope of a person skilled in the art, and therefore are not described herein.

Figure 3:
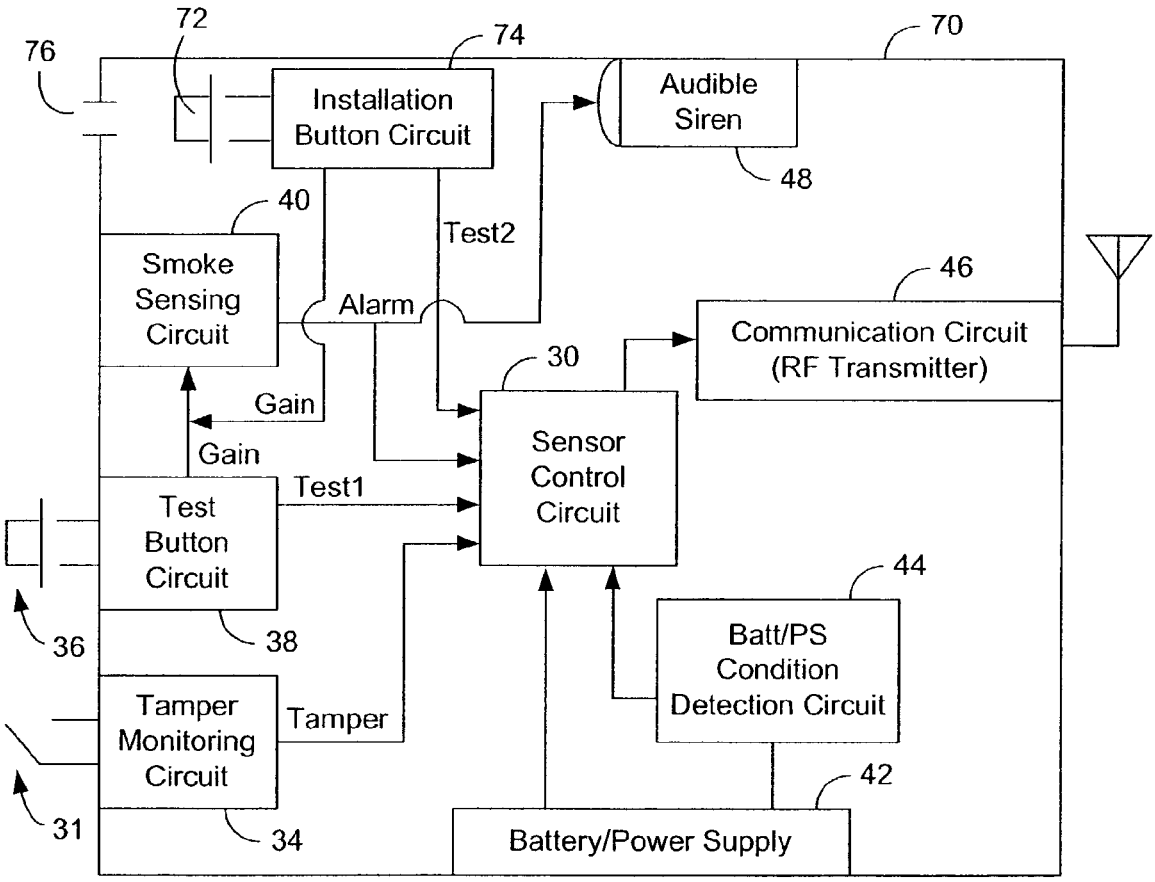
FIG. 3 is a block diagram of a wireless sensor in accordance with another embodiment of the invention.

FIG. 3 is a functional block diagram of another embodiment of a smoke detector 70 that is similar to detector 18 (shown in FIG. 2) but which includes an installation button 72 and an associated installation button application 74. Elements described with respect to FIG. 3 that are the same as elements described with respect to FIG. 2 utilize the same referenced numbers used in FIG. 2. In one embodiment, installation button application 74 detects activation of installation button 72 and provides a test signal (TEST2) to sensor control application 30, as well as a gain signal (GAIN) to smoke sensing application 40 similar to that provided by test button application 38 In an alternative embodiment, installation button application 74 does not provide a gain signal (GAIN) to smoke sensing application 40. Sensor control application 30 uses the test signal to determine whether installation button 72 is in an open or depressed state. In addition, if button 72 is depressed, application 30 may also measure the length of time that button 72 has been in the depressed state.

Installation button 72, in one implementation, is located within a housing of detector 70. The housing includes an opening 76 therethrough for access to installation button 72. Opening 76 in the sensor housing is sized such that elongated tools substantially similar in size to the diameter of an extended paper clip may be extended through opening 76. Opening 76 in the sensor housing is aligned with installation button 72 inside the housing so that extending an elongated tool, such as an extended paper clip for example, through opening 76 may be done to actuate the installation button 72. With such a design, a homeowner would be unlikely to actuate installation button 72, and may not even know it exists.

Figure 4:
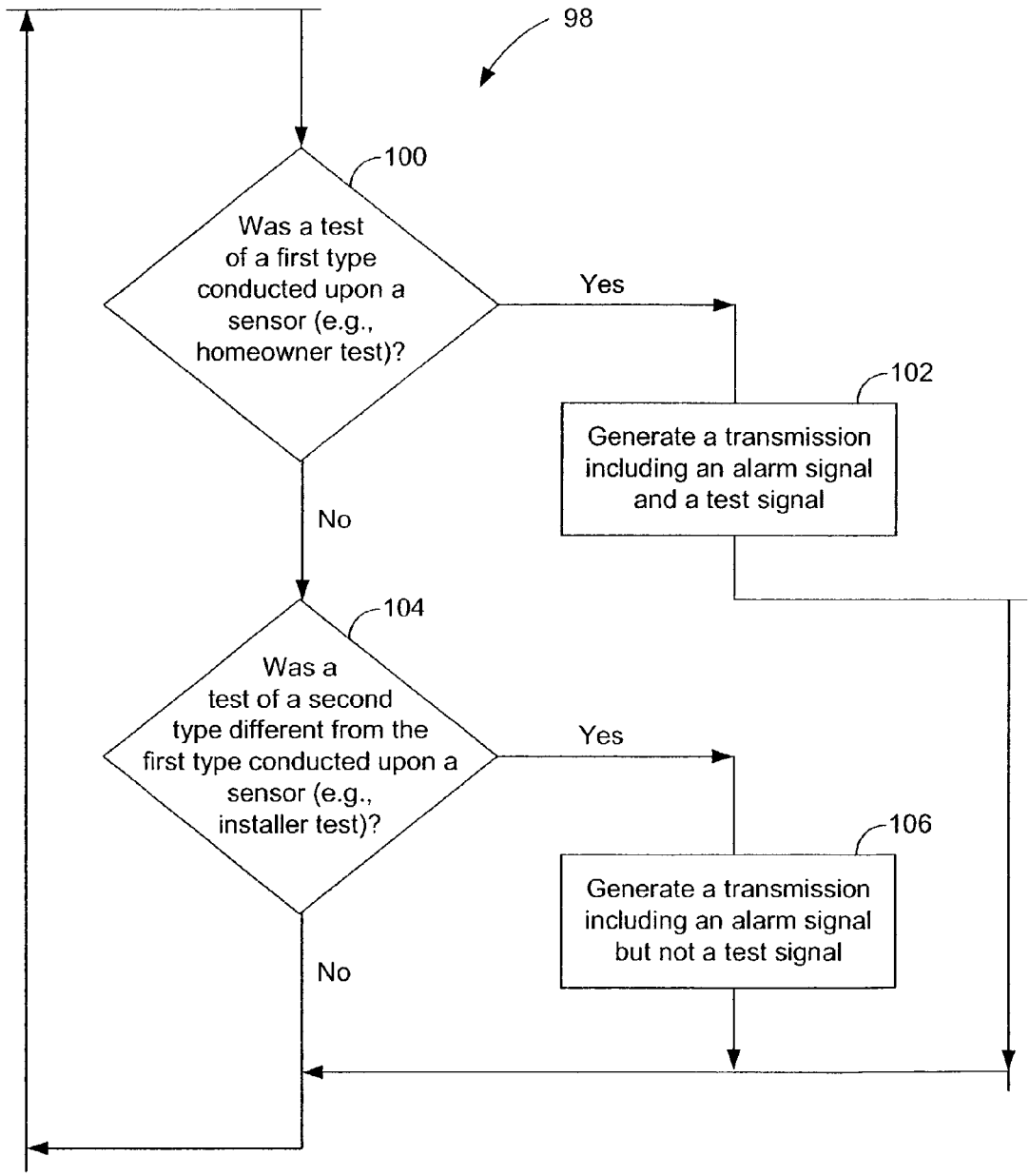
FIG. 4 is a flow chart showing the operation of a Sensor of the type shown in either FIG. 2 or FIG. 3, in accordance with an embodiment of the invention.

FIG. 4 is a flow chart 98 showing the operation of a detector similar to detector 18 shown in FIG. 2 and detector 70 shown in FIG. 3. Sensor control application 30 (shown in FIGS. 2 and 3) monitors signals (for example, ALARM, TEST, and TAMPER), and determines 100 whether the signals are related to a first type of test being conducted upon the sensors. As an example, the first type of test may be one designed for a homeowner to conduct, for example, to periodically check to ensure the sensor is working properly. If sensor control application 30 determines 100 that the signals it receives indicate that the first type of test has been conducted, then sensor control application 30, in connection with communication application 46, generates 102 a transmission that includes information indicating the presence of a sense condition sensed by the sensing device (for example, smoke sensing application 40) and information indicating that a test was conducted.

Alternatively, if the type of test conducted upon sensor is not of the first type, sensor control application 30 determines 104 whether the signals it is receiving indicate that a second type of test has been conducted. As an example, the second type of test may be one an installer conducts when installing the sensor in the security system. If sensor control application 30 determines that the signals indicate the second type of test has occurred, then sensor control application 30, in conjunction with communication application 46, generates 106 a transmission that includes information indicating the presence of the sensed condition but not information indicating that a test of the sensor was conducted. Once sensor control application 30 determines 100, 102, the type of test conducted, control application 30 continues monitoring its inputs.

As an example, in the FIG. 2 embodiment, the first type of test is actuating test button 36, perhaps for several seconds, in the absence of a predetermined condition (this predetermined condition is discussed below). When button 36 is actuated, test button application 38 produces the TEST signal received by sensor control application 30. In addition, test button application 38 provides the gain signal (GAIN) to smoke sensing application 40, which causes it to generate the ALARM condition output even though the condition that normally causes the ALARM condition to appear (namely, the presence of smoke or fire, for example) is not present. When sensor control application 30 detects the ALARM and TEST signals, sensor control application 30 in combination with communications application 46 generates a transmission with information indicating the presence of the sense condition and indicating that a test of the sensor was conducted, which transmission in turn is received by control panel 14 (shown in FIG. 1).

The second type of test, in the embodiment shown in FIG. 2, is likewise actuating test button 36, but with the predetermined condition present. In one implementation, the predetermined condition is the presence of the tamper signal (TAMPER), which indicates that the housing has been removed from sensor 18 or that sensor 18 is not properly mounted to a surface. In another implementation, the predetermined condition may be a condition that would only appear at the time of installation, for example, a fully charged battery being present in sensor 18. In yet another implementation, the predetermined condition may be the continued activation of test button 36 for a predetermined period of time that is considerably longer than the time required for the first type of test discussed above. For example, the predetermined time period may be 10 seconds or more. After test button 36 has been actuated for a period of time less than 10 seconds, an audible or visual signal informs a user that if test button 36 continues to be actuated sensor 18 will imminently make, the type of transmission made when the predetermined condition is present. In addition, the control panel provides the user an abort window in which the imminent report can be canceled. If the alarm transmission is not immediately preceded by the test, then the control panel does not provide this abort window. This type of transmission includes information indicating the presence of the sense condition but not information indicating that a test was conducted.

As another example, in the FIG. 3 embodiment, the first type of test is actuating test button 36. However, the predetermined condition discussed above in connection with the FIG. 2 embodiment need not be absent for the first type of test, and in fact may be present when test button 36 is actuated in some implementations and still effect the first type of test. When test button 36 in sensor 70 is actuated, sensor 70 generates a transmission with information indicating both presence of the sense condition and that a test of sensor 70 has been conducted. The second type of test is actuating installation button 72 and causing sensor 70 to generate a transmission with information indicating the presence of the sense condition, but not that a test has been conducted. Therefore, sensor 70 generates a transmission that will appear to a control panel to indicate that an actual alarm condition is present.

Figure 5:
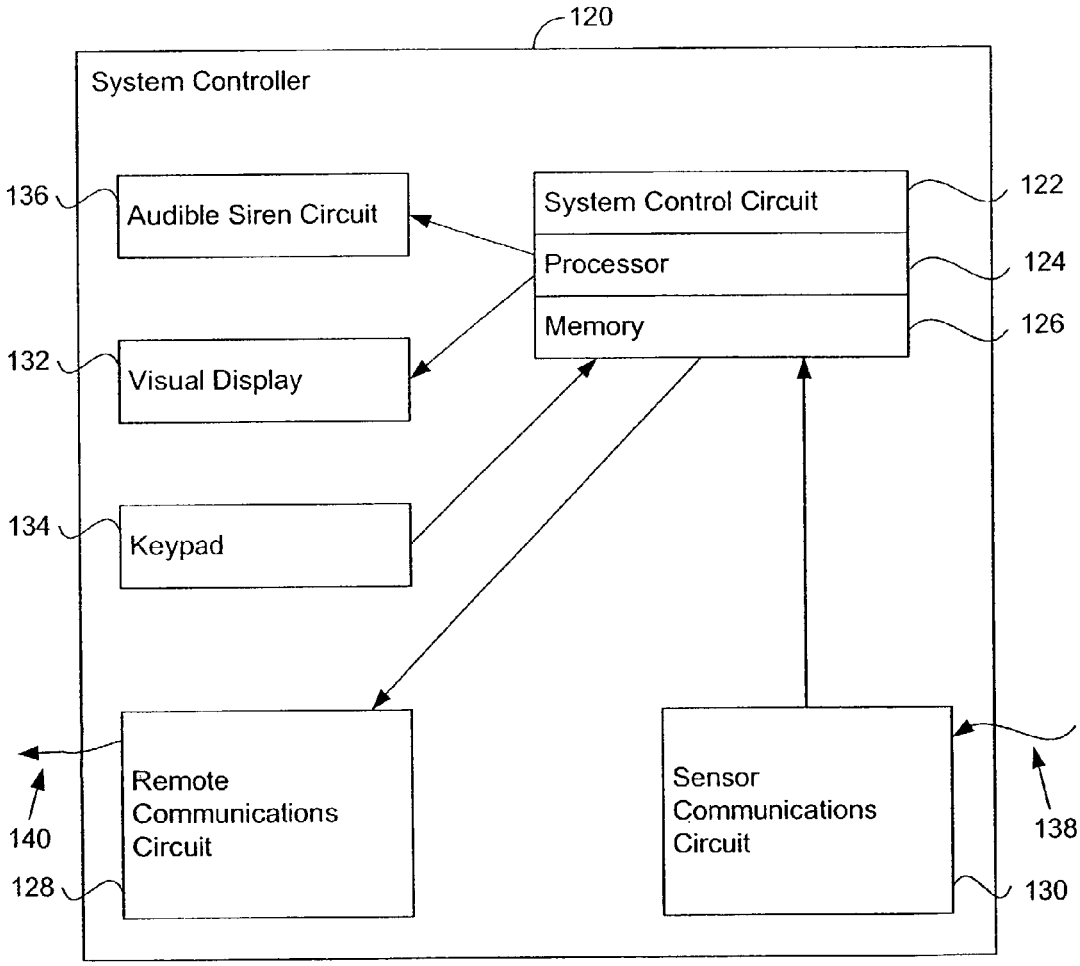
FIG. 5 is a block diagram of a control panel shown in FIG. 1 that may be programmed to operate in accordance with various embodiments of the invention.

FIG. 5 is a functional block diagram of a control panel 120, similar to control panel 20 shown in FIG. 1. Control panel 120 includes a system control application 122 having a processor 124 for executing a program stored in a memory 126. The program includes software instructions for managing the operation of control panel 120. Control panel 120 also includes a remote communications application 128, a sensor communications application 130, a visual display 132, a keypad 134, and an audible siren application 136.

System control application 122 receives sensor signals from a smoke detector, such as detector 18 shown in FIG. 2, and other sensors, in one implementation, over a wireless communications path 138 via sensor communications application 130 (receiver). Remote communications application 128 allows system control application 122 to generate transmissions via a communication path 140 to the monitoring station. Keypad 134 in combination with visual display 132 permits the user to configure control panel 120 to operate in various modes which can affect how the sensor signals are processed. For example, the different modes of operation can be presented on visual display 132 allowing the user to select a particular mode of operation through keypad 134. The different modes of operation are discussed below. System controller application 122 can use audible siren application 136 to generate audible signals indicating various conditions sensed by sensors 16 (shown in FIG. 1) and smoke detector 18.

Figure 6:
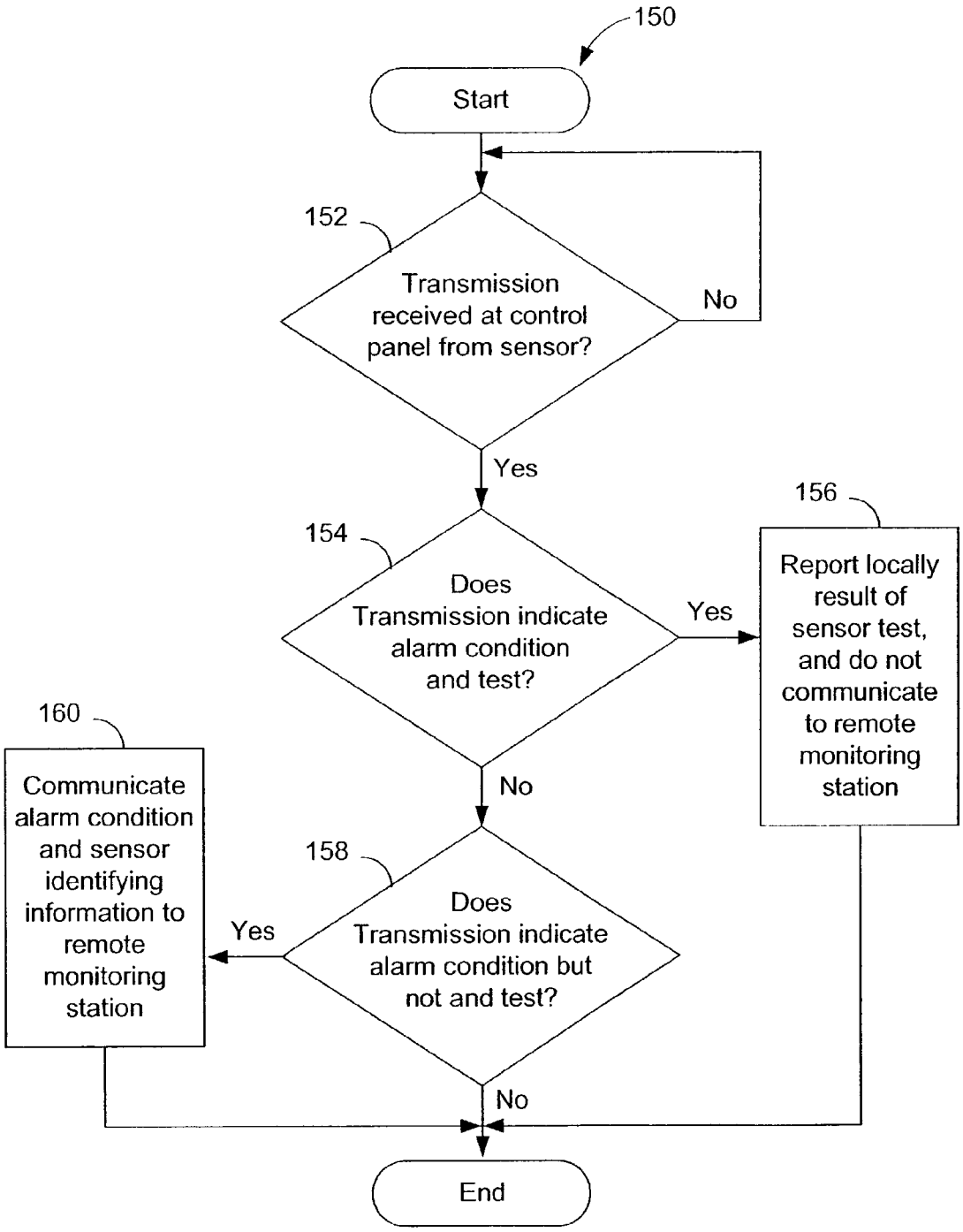
FIG. 6 is a flow chart showing operation of the control panel of FIG. 5 with sensors of the type shown in FIG. 2 or 3, in accordance with an embodiment of the invention.

FIG. 6 is a flow chart 150 illustrating operation of control panel 120 when used with sensors, similar to sensors 18 (shown in FIG. 2) and 70 (shown in FIG. 3). Control panel 120 receives 152 a transmission from a sensor such as sensor 18 or 70, and determines 154 whether the received transmission includes information indicating the presence of the sense condition. Control panel 120 also determines 154 whether information was received indicating that a test was conducted. A test is determined to have been conducted when test button 36 (shown in FIGS. 2 and 3) has been actuated in the absence of the predetermined condition in the implementation of the FIG. 2 embodiment, or simply actuated with or without the predetermined condition in the implementation of the FIG. 3 embodiment. If control panel 120 receives information indicating the presence of the same condition and that the test was conducted, control panel 120 does not communicate 156 with the remote monitoring station and locally reports the result of the sensor test. As such, a homeowner's test of the sensor by pressing test button 36, for example, does not cause a false alarm to be reported to the remote monitoring station.

If the transmission does not include information indicating a test, control panel 120 determines 158 whether the received transmission includes information indicating the presence of the sense condition but without information indicating that a test of the sensor was conducted. Such a transmission may have been caused by smoke sensing application 40 (shown in FIG. 3) sensing the presence of smoke, by test button 36, in the FIG. 2 embodiment, being actuated with the predetermined condition present, or by test button 36 in the FIG. 3 embodiment simply being actuated. If such a transmission is determined 158 to have been received, control panel 120 communicates 160 to the remote monitoring station, providing information indicating that an alarm condition is present and possibly providing sensor identifying information for the sensor that made the transmission. As such, the predetermined condition may be used to cause control panel 120 to communicate sensor identifying information to the remote monitoring station for purposes of fraud prevention measures to verify that the sensor has been installed in the security system. Before such a verification communication is done, however, an installer will normally notify the remote monitoring station that such a communication is soon to come, so the remote monitoring station knows there is not an actual alarm.

In an alternative embodiment of the invention, control panel 120 has a special mode of operation in which communication with a remote monitoring station to provide sensor information occurs without the need for the predetermined condition as in the FIG. 2 embodiment or installation button 72 as in the FIG. 3 embodiment. In this alternative embodiment, control panel 120 communicates with the remote monitoring station even when control panel 120 receives a sensor transmission including information indicating that a test of the sensor has been conducted, and as such control panel 120 determines that the transmission was not made because an alarm condition is present at the sensor.

Figure 7:
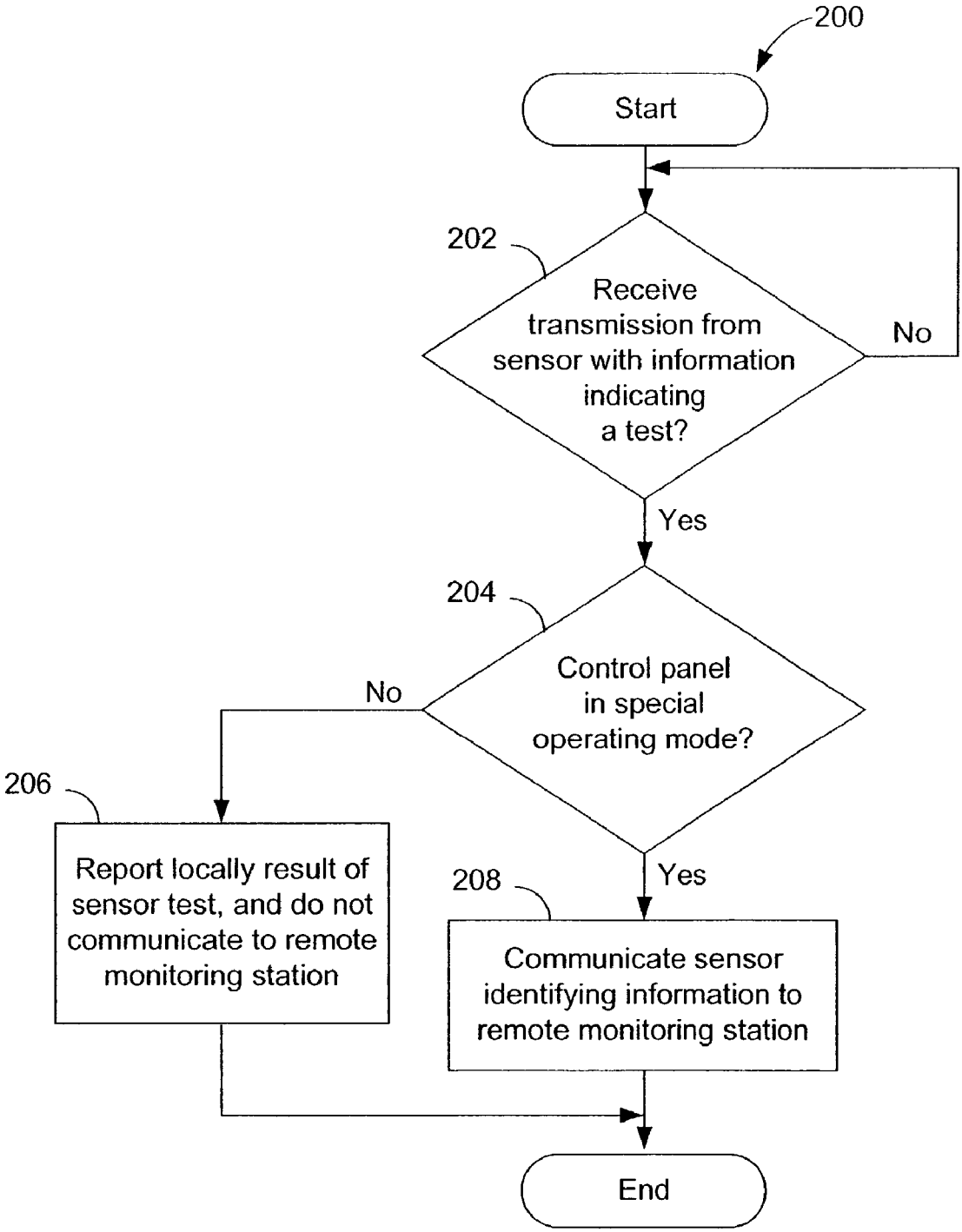
FIG. 7 is a flow chart showing operation of the control panel of FIG. 5 in accordance with another embodiment of the invention.

FIG. 7 is a flow chart 200 showing the operation of control panel 120 programmed in this manner. Control panel 120, upon receiving a transmission from a sensor, determines 202 whether the transmission includes information indicating that a test of the sensor has been conducted. If the transmission does not include such information, control panel 120 continues to monitor for such a transmission. If control panel 120 receives such a transmission, it determines 204 whether control panel 120 is operating in a special operating mode. If control panel 120 is operating in a normal operating mode including, for example, an "armed" mode, control panel 120 does not send a communication to the remote monitoring station. Instead, the test condition is locally reported 206 for example, by generating a sound using audible siren application 136 (shown in FIG. 5) or generating a visual indication using visual display 132 (shown in FIG. 5). If control panel 120 determines that control panel 120 is in the special operating mode, control panel 120 sends 208 a communication to remote monitoring station 15 with information identifying the sensor that made the transmission, thus providing verification that the sensor has in fact been installed.

Figure 8:
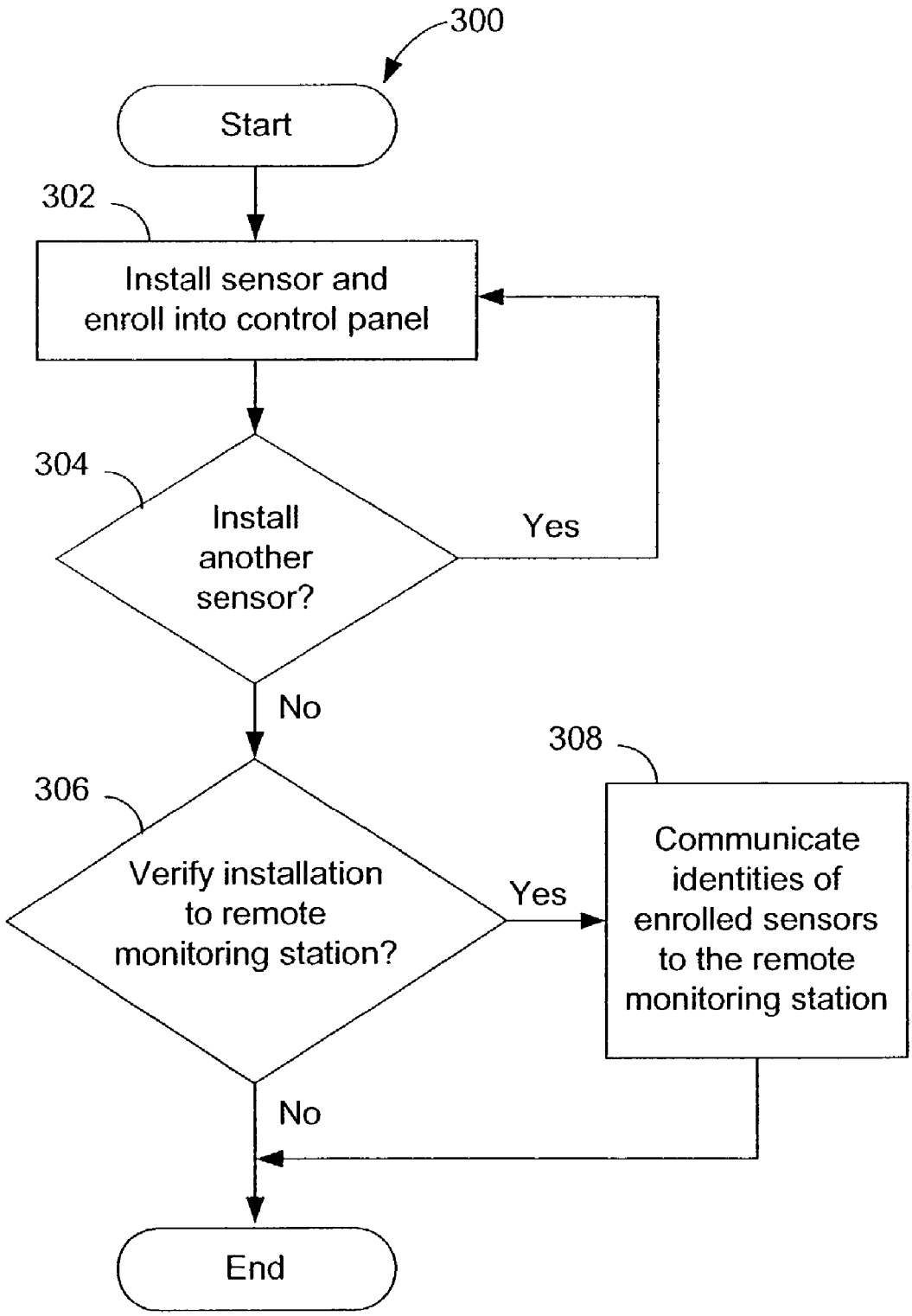
FIG. 8 is a flow chart showing operation of the control panel of FIG. 5 in accordance with yet another embodiment of the invention.

FIG. 8 is a flow chart 300 illustrating the operation of a further embodiment of the invention in which a control panel has a "verification mode." In this embodiment, communication to the remote monitoring station is made even in response to receiving a sensor transmission with information indicating that a test of the sensor was conducted. Sensors are installed 302 in a security system, and as part of that process, identifier information for each of the various installed sensors is enrolled into control panel 120. Control panel 120 then prompts the installer, such as at visual display 132 (shown in FIG. 5), regarding whether another sensor is to be installed 304. If another sensor is to be installed control panel 120 enrolls 302 another sensor into control panel 120. If another sensor is not to be installed, the installer determines whether to verify 306 to the remote monitoring station the identities of the sensors that have been installed. If it is decided to verify the identities of the sensors, the installer uses keypad 134 to enter the verification mode and communicates 308 the identities of the enrolled sensors to the remote monitoring. Sensor information may be communicated to the remote monitoring station after each sensor is installed, in which case following verification 306 of operation the installer may prompt control panel 120 to return to step 302 and enroll, and perhaps verify, another sensor. Alternatively, the sensor information for several sensors may be communicated at one time in a single communication session, for example, when several sensors are enrolled before verification.

While the invention has been described in terms of various specific embodiments, those skilled in the art will recognize that the invention can be practiced with modification within the spirit and scope of the claims.

What is claimed is:

1. A method of operating a sensor in a security system having a control panel that receives transmissions from the sensor and the sensor has a user-operable test button that tests a condition sensing device in the sensor, the method comprising:

generating, in response to actuation of the test button in the absence of a predetermined condition, a transmission from the sensor including information indicating that a test of the sensor has been conducted;

receiving by the control panel, in response to actuation of the test button in the presence of the predetermined condition, a transmission from the sensor indicating that the control panel should not report to a monitoring station; and upon depressing the test button in the presence of the predetermined condition, generating a transmission from the sensor including information indicating the presence of a sensed condition sensed by the sensing device, wherein the transmission including information indicating the presence of the sensed condition does not include information indicating that a test of the sensor has been conducted.

2. A method in accordance with claim 1 wherein the transmission generated in response to actuation of the test button in the absence of the predetermined condition includes information indicating the presence of the sensed condition sensed by the sensing device.

3. A method in accordance with claim 1 wherein the sensor is a smoke detector.

4. A method in accordance with claim 1 wherein the predetermined condition is at least one of a tamper condition, a signal indicating that batteries have been recently installed in the sensor, and continued actuation of the test button for a predetermined period of time.

5. A method in accordance with claim 4 further comprising providing at the control panel, after the test button of the sensor has been actuated for a predetermined period of time, an indication that the sensor will imminently make, if the test button continues to be actuated, the transmission of information indicating the presence of the sensed condition sensed by the sensing device but not information indicating that a test has been conducted.

6. A method in accordance with claim 5 wherein the indication provided at the control panel is at least one of an audible indicator and a light being illuminated.

7. A method in accordance with claim 4 further comprising providing at the sensor, after the test button of the sensor has been actuated for a predetermined period of time, an indication that the sensor will imminently make, if the test button continues to be actuated, the transmission of information indicating the presence of the sensed condition sensed by the sensing device but not information indicating that a test has been conducted.

8. A method in accordance with claim 1 further comprising:

alerting the user, when the control panel receives an alarm transmission subsequent to the test, that the control panel will imminently report an alarm; and providing the user an abort window in which the imminent report can be cancelled.

9. A method in accordance with claim 8 wherein if the alarm transmission is not immediately preceded by the test, then the control panel does not provide this abort window.

10. A method in accordance with claim 1 wherein transmissions from the sensor are wireless transmissions.

11. A method in accordance with claim 1 wherein the sensor has a hard-wired connection to the control panel and transmissions from the sensor to the control panel propagate via the hard-wired connection.

12. A method in accordance with claim 1 further comprising:

upon the control panel receiving the transmission from the sensor including information indicating the presence of the sensed condition sensed by the sensing device but not information indicating that a test has been conducted, communicating from the control panel to a remote monitoring station that the sensing device in the sensor has sensed the presence of the sensed condition; and upon the control panel receiving the transmission from the sensor including information indicating the presence of the sensed condition sensed by the sensing device and information indicating that a test has been conducted, not making a communication from the control panel to the remote monitoring station.

13. A method of operating a sensor in a security system having a central control panel that receives transmissions from the sensor, the sensor has first and second user-operable test buttons, at least one of the first and second test buttons test a condition sensing device in the sensor, the method comprising:

generating, in response to actuation of the first test button, a transmission from the sensor including information indicating that a test of the sensor has been conducted;

receiving by the control panel, in response to actuation of the first test button in the presence of a predetermined condition, a transmission from the sensor indicating that the control panel should not report to a monitoring station; and upon depressing the second test button in the presence of the predetermined condition, generating a transmission from the sensor including information indicating the presence of a sensed condition sensed by the sensing device, wherein the transmission including information indicating the presence of the sensed condition does not include information indicating that a test of the sensor has been conducted.

14. A method in accordance with claim 13 wherein the transmission generated in response to actuation of the first test button includes information indicating the presence of the sensed condition sensed by the sensing device.

15. A method in accordance with claim 13 wherein the sensor is a smoke detector.

16. A method in accordance with claim 13 wherein transmissions from the sensor are wireless transmissions.

17. A method in accordance with claim 13 wherein the sensor has a hard-wired connection to the control panel and transmissions from the sensor to the control panel propagate via the hard-wired connection.

18. A method in accordance with claim 13 further comprising:

upon the control panel receiving the transmission from the sensor including information indicating the presence of the sensed condition sensed by the sensing device but not information indicating that a test has been conducted, communicating from the control panel to a remote monitoring station that the sensing device in the sensor has sensed the presence of an alarm condition; and upon the control panel receiving the transmission from the sensor including information indicating that that a test has been conducted, not making a communication from the control panel to the remote monitoring station.

19. A method in accordance with claim 18 wherein the communication of information indicating that a test has been conducted also includes information that indicates that the sensed condition has been sensed.

20. A sensor for use in a security system having a control panel that receives transmissions from the sensor, the sensor comprising:

a sensing device for sensing a condition and having an output indicating whether or not the sensed condition is present;

a test button that when actuated conducts a test of the sensing device and causes the sensing device output to indicate that the sensed condition is present if the sensor is working properly; and at least one control and communications application that receives the output of the sensing device and senses whether the test button has been actuated, wherein the control and communications application:

transmits, in response to the sensing device output indicating that the sensed condition is present and that the test button was actuated in the absence of a predetermined condition, a signal for receipt by the control panel including information that the test button was actuated, and upon receiving the sensing device output indicating that the sensed condition is present and indicating that the test button was depressed in the presence of the predetermined condition, transmits a signal for receipt by the control panel including information that the sensing device output is indicating that the sensed condition is present but not that the test button was depressed.

21. A sensor in accordance with claim 20 wherein the at least one control and communications application also receives the output of a testing device and utilizes the output of the sensing device and the testing device to sense whether the test button has been actuated.

22. A sensor in accordance with claim 20 wherein the signal transmitted in response to the sensing device output indicating that the sensed condition is present and that the test button was actuated in the absence of the predetermined condition includes information that the sensing device output indicates that the sensed condition is present.

23. A sensor in accordance with claim 20 further comprising a tamper detection device, the predetermined condition being an indication of tampering by the tamper detection device, and wherein the tamper detection device indicating tampering of the sensor is the predetermined condition.

24. A sensor in accordance with claim 20 further comprising:

a battery that provides electrical power to the sensor; and a battery condition detection application that determines a charge status of the battery and that has an output indicating whether a battery has recently been installed, wherein an indication that a battery has recently been installed is the predetermined condition.

25. A sensor in accordance with claim 20 wherein the predetermined condition is a continued actuation of the test button for a predetermined period of time.

26. A sensor in accordance with claim 20 wherein the predetermined condition is a temporal sequence of tamper switch operations.

27. A sensor in accordance with claim 20 wherein the sensing device senses the presence of smoke.

28. A sensor in accordance with claim 20 wherein transmissions from the sensor are wireless transmissions.

29. A sensor for use in a security system having a control panel that receives transmissions from the sensor, the sensor comprising:

a sensing device for sensing a condition and having an output indicating whether or not the sensed condition is present;

first and second test buttons, when at least one of the first and second test buttons is depressed, a test button application conducts a test of the sensing device and causes the sensing device output to indicate that the sensed condition is present if the sensor is working properly; and at least one control and communications application that receives the output of the sensing device, wherein the control and communications application:

transmits, in response to the sensing device output indicating that the sensed condition is present and that the first test button was actuated, a signal for receipt by the control panel including information that a test of the sensing device has been conducted;

receives from the sensing device a signal for receipt by the control panel including information indicating that the control panel should not report to a monitoring station; and upon receiving the sensing device output indicating that the sensed condition is present and that the second test button was depressed in the presence of a predetermined condition, transmits a signal for receipt by the control panel including information that the sensing device output is indicating that the sensed condition is present, wherein the signal including information that the sensing device output is indicating that the sensed condition is present does not include information that a test of the sensing device has been conducted.

30. A sensor in accordance with claim 29 wherein the signal in response to the sensing device output indicating that the sensed condition is present and that the first test button was actuated includes information that the sensing device output indicates that the sensed condition is present.

31. A sensor in accordance with claim 29 wherein the first test button comprises a test button located external of a housing for the sensor.

32. A sensor in accordance with claim 29 wherein the second test button is located within the sensor housing, and the sensor housing has a hole therethrough for access to the second test button.

33. A sensor in accordance with claim 29 wherein the sensor is a smoke sensor.

34. A method for use in a security system for a premises, the security system comprising a plurality of sensors that transmit to a control panel which in turn communicates with a remote monitoring station, the method comprising:

receiving at the control panel a first type of transmission from one of the plurality of sensors, the first type of transmission including information that a test of a sensing device was conducted;

when the control panel is operating in a first mode, upon receiving the first type of transmission having specific content, the control panel does not send a communication to the remote monitoring station indicating the presence of a condition at the premises; and when the control panel is operating in a second mode different than the first mode, upon receiving the first type of transmission with the specific content, the control panel sends a communication to the remote monitoring station indicating the presence of the condition at the premises and an identity of the one of the sensors that sensed the condition, wherein the identity distinguishes the one of the sensors from the remaining of the sensors.

35. A method in accordance with claim 34 the first type of transmission includes information that the sensing device within the one of the sensors that sensed the condition.

36. A method in accordance with claim 34 wherein the second mode is an installation mode used during the installation of the sensors in the security system.

37. A method in accordance with claim 34 further comprising, if the control panel is operating in the first mode and receives a second type of transmission from the sensor indicating that the sensing device within the one of the sensors has sensed the condition and that a test of the one of the sensors has not been conducted, the control panel sends, upon receiving the transmission of the second type, a communication to the remote monitoring station indicating the presence of the condition at the premises.

38. A method for use in a security system for a premises, the security system comprising a sensor that transmits to a control panel which in turn communicates with a remote monitoring station, the method comprising:

receiving, at the control panel and from a sensor, a transmission including an identity of the sensor; and forwarding in a verification mode, from the control panel to the remote monitoring station, the identity for the sensor, wherein the remote monitoring station is separate from the sensor and configured to dispatch an emergency department upon receiving an alarm condition, said forwarding occurs upon receiving a signal from the sensor indicating that a test of the sensor is conducted, and said forwarding in the verification mode occurs when the at least one sensor is installed within the security system.

39. A control panel for a security system for a premises having at least one sensor that communicates with the control panel which communicates with a remote monitoring station, the control panel comprising:

a receiver to receive transmissions from at least one sensor;

a communications application to communicate with the remote monitoring station;

a user settable mode selector to place the control panel in a verification mode;

a controller; and memory having instructions stored thereon that when executed by the controller perform the following operations:

upon receiving at least one identity of the at least one sensor, the controller stores in memory the at least one identity, and when in the verification mode, communicating the at least one identity to the remote monitoring station that is separate from the at least one sensor and the control panel and configured to dispatch an emergency department upon receiving an alarm condition, and said communicating the at least one identity occurs when the at least one sensor is installed within the security system and upon receiving at least one signal from the at least one sensor indicating that a test of the at least one sensor is conducted.

40. A control panel in accordance with claim 39 wherein the at least one identity includes and plurality of identities and the at least one sensor includes a plurality of sensors, and the control panel communicates the identities to the remote monitoring station for the sensors in a single communication session.

* * * * *